United States Patent [19]

Kraus

[11] 4,411,084

[45] Oct. 25, 1983

[54] DISPLAY WITH CHANGEABLE CHARACTERS

[75] Inventor: John W. Kraus, Teaneck, N.J.

[73] Assignee: Trans-World Manufacturing Corp., East Rutherford, N.J.

[21] Appl. No.: 271,001

[22] Filed: Jun. 5, 1981

[51] Int. Cl.[3] ..... G09F 9/37

[52] U.S. Cl. ..... 40/450; 40/497; 40/536; 40/623; 40/601

[58] Field of Search ..... 40/447, 449, 450, 451, 40/452, 489, 492, 493, 497, 498, 499, 601, 603, 608, 613, 10 R, 623, 536; 273/159; 248/475 B, 575, 621, 609; 403/97

[56] References Cited

U.S. PATENT DOCUMENTS

| | | | |
|---|---|---|---|
| 1,357,457 | 11/1976 | Jorgensen | 40/450 |
| 1,599,066 | 9/1926 | Rushmore | 40/608 |
| 1,752,251 | 3/1930 | Giroux | 40/450 |
| 2,141,473 | 12/1938 | Hubertz | 40/450 |
| 3,250,031 | 5/1966 | Bowman | 40/450 |
| 3,273,270 | 9/1966 | Skrobisch | 40/450 |
| 3,330,594 | 7/1967 | Cadle | 403/97 |
| 3,740,878 | 6/1973 | Oelschlaeger | 40/450 |
| 3,789,525 | 2/1974 | Bugg | 40/449 |
| 3,949,392 | 4/1976 | Caritato | 340/336 |
| 4,024,532 | 5/1977 | Sherwin | 340/336 |
| 4,063,377 | 12/1977 | Hukill | 40/447 |
| 4,142,311 | 3/1979 | Lane | 40/109 |
| 4,164,824 | 8/1979 | Nidelkoff | 40/450 |
| 4,205,472 | 6/1980 | Shirley | 40/608 |
| 4,223,464 | 9/1980 | Winrow | 40/449 |

*Primary Examiner*—Gene Mancene
*Assistant Examiner*—David I. Tarnoff

[57] ABSTRACT

A display having mechanically changeable characters and a support for the display are disclosed. The display comprises an array of mechanical flip-flop elements which can each be rotated between two orientations exposing one of two visually different sides. The flip-flop elements are bars secured resiliently by springs to a frame in such a manner that each flip-flop element can be manually pulled away from the frame, rotated to change its orientation, and released to snap back against the frame. The flip-flop elements are arranged in groups of seven, each group having its seven flip-flop elements arranged into two adjacent quadrilaterals of equal size, one flip-flop element being common to both quadrilaterals. Channels are provided on the rear side of the frame to receive the springs. Various lengths for the flip-flop elements are disclosed. The support maintains the display in an elevated position and draws up the display by means of a retractable cable. A securement device holds the display up. Guide posts on the support guide the display back up into position after being lowered, the retractable cable being passed through the posts.

40 Claims, 10 Drawing Figures

FIG. 2.
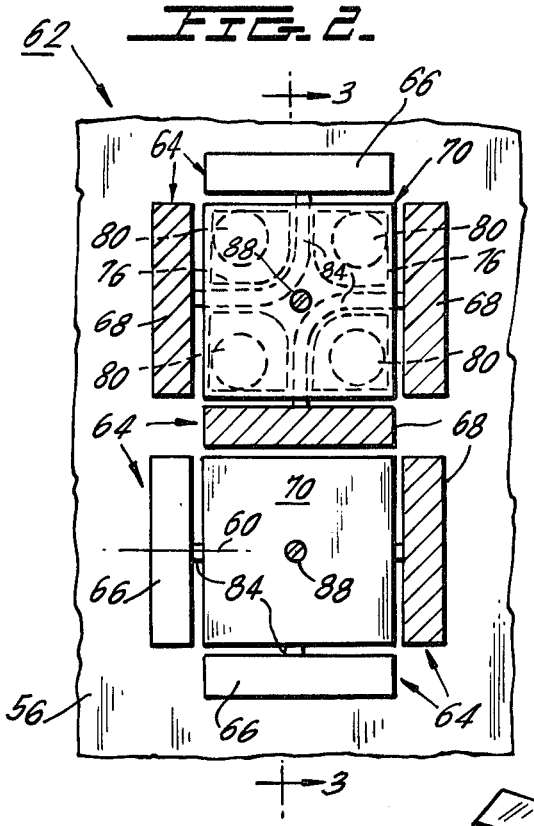
FIG. 3.
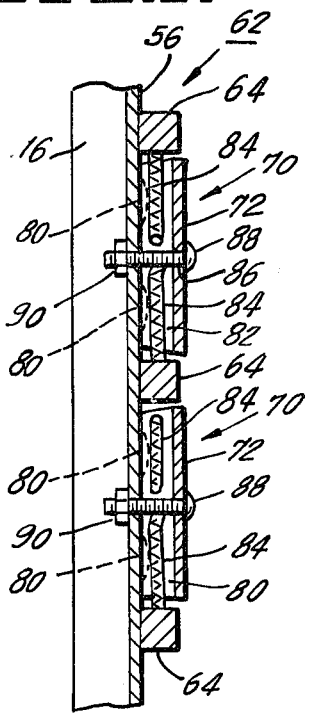
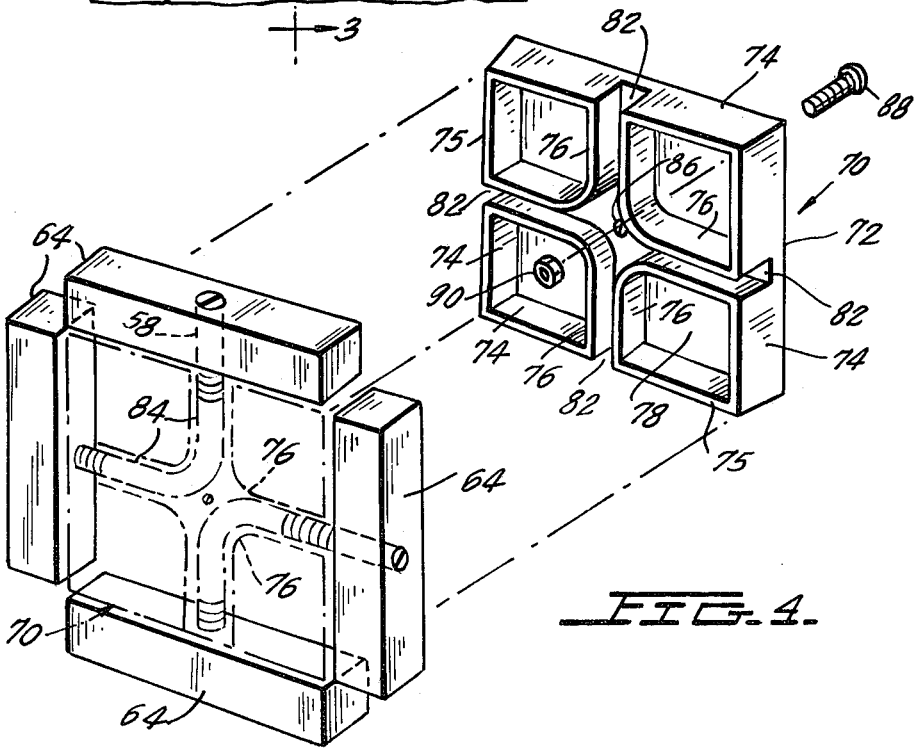
FIG. 4.

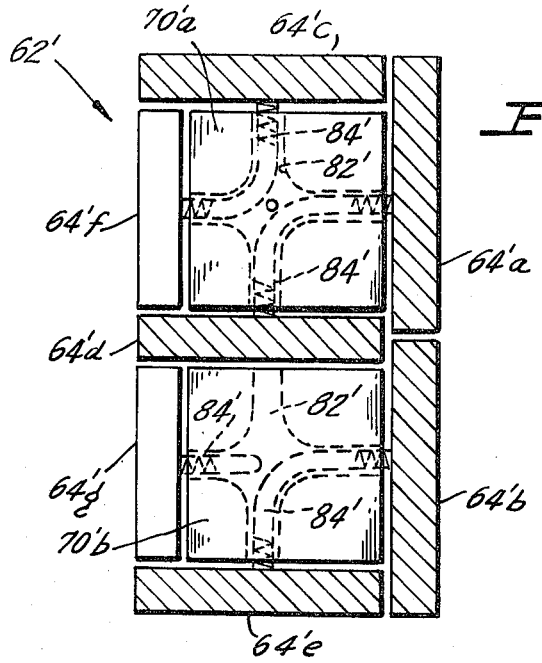
FIG. 9.
FIG. 7
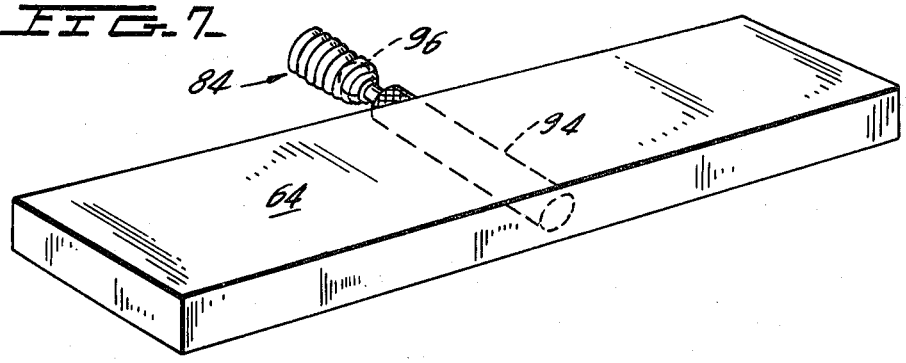
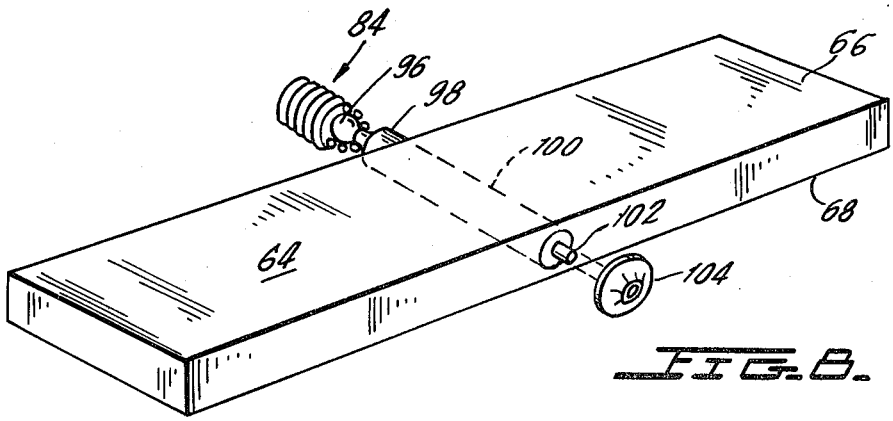
FIG. 8.

DISPLAY WITH CHANGEABLE CHARACTERS

BACKGROUND OF THE INVENTION

The present invention is concerned with a display, such as a commercial sign, with mechanically changeable characters and also concerns a support for the display.

Sometimes a display is at ground level which eases access to the characters on the display for changing them. However, a display, such as a commercial sign located, for example, at an automobile service station, may be at a considerable elevation above the ground so that it can be seen at great distances by motorists driving past. Because of the relative inaccessibility of an elevated display to persons on the ground, the message on the display has typically been a permanent message, not one that would be frequently changed. For example, the brand of gasoline sold at a particular service station might appear on the display, but the unit price of the fuel on that particular day would not appear, because the price might have to be changed too frequently.

For working on a very tall display, a person can be lifted up to the display or he can use an extension tool to reach the display. Both of these techniques are awkward and require extra equipment for the operator or considerable dexterity of the operator. The inconvenience in operating upon the display may result in the display either not being used at all or being less frequently changed than it should be. Easier access to a quite tall display for changing it is desirable, therefore.

Once access to the display has been attained, it is desirable to be able to readily change the characters or message appearing on the display. For example, where the display is of the price of the product being sold, such as gasoline at an automobile service station, the numerals on the display are changed frequently.

Typically, there is a separate storage bin for each of the characters, and changing the display involves removing one character, replacing it in the correct storage bin and substituting a new character extracted from its storage bin. This requires carrying a container of characters to the display, maintaining the characters correctly in their storage bins, and may require somewhat complex manipulative steps for changing characters. It is helpful to have all of the means needed for changing characters located directly on the display so that no character storage means would be needed. It is also desirable for a tall display or for any display in general to have all of the means needed for changing the characters located at the display itself.

Various displays have been developed with multi-element characters where the characters are defined by a series of variable elements that are carried on a supporting frame. By appropriately arranging the plurality of elements, a particular character appears.

Various multi-element characters, with changeable individual elements for changing the characters, are known, for instance, from U.S. Pat. Nos. 1,357,457; 3,273,270 and 4,024,532. In addition, characters comprised of elements which are changed in position to change the appearance of the elements and thereby change the character viewed are known from U.S. Pat. Nos. 2,141,473; 3,740,878; 3,949,392; or 4,223,464.

SUMMARY OF THE INVENTION

It is a primary object of the present invention to simplify changing the characters or numbers on a display.

It is another object of the invention to enable the characters on a display to be changed without requiring additional equipment, components, character elements, etc. to be brought to the display in order that the change in the characters might be effected.

It is a further object of the invention to securely hold elements of a multi-element character in proper positions for displaying a particular character and for also permitting the elements of the character to be easily changed as desired.

It is another object of the invention to facilitate mechanically changing the characters or message on a display that is normally remote from an operator, e.g. a tall display.

The invention is also adapted to avoid the need for expensive remote control digital readout systems, such as those employing solid state controls, electrified displays, etc. Instead, the invention relies on simple mechanically changed characters which may be changed manually by the operator having the display within his reach.

According to the present invention, a display which can be located remote from an operator, particularly a tall display, includes a part that is to be changed. The changeable part of the display is movable and is attached to a retraction mechanism which normally draws the changeable part of the display back to its remote or upraised position. For example, the changeable part of the display may be attached to a spring-loaded, retractable cable mechanism. When some change should be made in the display, for example, the price on the display, an operator simply pulls the changeable part of the display down to him, by using a separate pole or hook or by using a cable, pole, or the like, which is permanently attached to the changeable part of the display. In the latter case, separate equipment need not be brought to the display in order to move the changeable part of the display toward the operator. Once the display has been changed, the operator permits the changeable part of the display to retract to its upraised position.

An entire display includes two principal parts, a movable part of the display and a mounting support for the movable part of the display. The mounting support may include a permanent message, e.g. the trademark of the gasoline service station. In this case, the movable part of the display carries changeable information, such as the price of gasoline. The price information would be provided by the changeable characters, described below. Other changeable information might be included on the movable part of the display through slide-in panels supported on the movable part of the display. The movable part of the display carrying the changeable information retracts to a predetermined position with respect to the mounting support for providing a complete message.

The display is typically flat. In one version, all of the characters on the display are at one side of the display. However, the display may have two opposite faces which carry messages and the messages on the opposite faces may be the same or different. A two-sided display may be formed in two separate, single-sided sections which are joined together or may be formed as a single molded unit.

The mounting support may hold the movable part of the display, so that the movable part of the display will not shake or rattle due to ambient conditions, such as high wind, vibration from passing traffic, etc. In one preferred embodiment, pins project down from the mounting support. As the movable part of th display retracts, the pins are received in receptacles in the movable part of the display for holding the movable part of the display stationary as required. Temporary fastening means may hold the movable, changeable part of the display in its upraised position, so that it is not necessary to merely rely upon a tensioned retraction device to hold the movable part upraised and so that in the event of ice or snow forming on the display or other unexpected downward forces being applied to the movable part of the display, they will not cause the movable part of the display to undesirably move down.

The above described arrangement is useful for a display on which the information is to be changed, for example, as described below. However, with displays of other kinds, the retractable nature of the movable part of the display permits any appropriate changes to be made, e.g. light bulbs may be changed in an illuminated display, advertising signs and pictures may be changed, etc. For example, if the movable part of the display includes a translucent picture, the display may also include illumination means, such as incandescent light bulbs. The picture may be periodically changed by an operator at ground level. In one application of this, a store might promote or a food establishment might display a particular food item in this way, etc.

To enable mechanically changing the characters in the display without requiring that a container of separate characters be kept for this purpose, according to the inventions, each changeable character in the display comprises an arrangement of mechanical flip-flop elements adapted to be mechanically shifted between two orientations to display two different surfaces or sides. The mechanical flip-flop elements are preferably bars and particularly rectangular shaped and rectangular cross-section bars. Each flip-flop element has a different viewable characteristic on each of two respective surfaces or sides, and preferably on the opposite surfaces. For example, the two surfaces may be of different colors. One surface of each element or bar may be colored in a background color, such as the color of the display itself, and the other surface of the element may be in a highly contrasting color. For example, the two surfaces may be respectively black and white. Depending upon which surfaces of the flip-flop elements in an array are exposed, different characters will be presented by the array of elements.

In digital displays of numerals, e.g. in liquid crystal displays, a total of seven bars arranged to define a rectangle comprised of two quadrilaterals, in the form of two squares or rectangles, one above the other, with one of the bars serving as the common side of the two squares, provides enough bars to produce every numeral character 0–9. In place of liquid crystals which can be selectively turned on and off, the invention uses the bar shaped flip-flop elements described above. As appropriate, other arrangements, quantities and arrays of flip-flop elements may be selected for creating different characters or for different display purposes, within the contemplation of the invention. For changing a particular character, it is merely necessary for an operator to flip or reorient the appropriate flip-flop elements so that their correct surfaces are exposed for creating the desired character.

The movable flip-flop elements are supported by a stationary support frame and move with respect to the support. In the seven bar, two square, rectangular array, the support comprises two square shaped, forwardly projecting frames and the flip-flop elements seat at the edges of the two square frames. The flip-flop elements are held to their frames in a manner which maintains them stationary and in the desired position, but which also permits the flip-flop elements to be reoriented so that their different surfaces can be exposed. The frames are, in turn, attached on or even integrated with an entire supporting panel.

According to a preferred embodiment, the flip-flop elements are held to their frames by tension springs. Adjustment of each flip-flop element involves pulling it away from the frame, i.e. lifting the flip-flop element up slightly from the background supporting panel on which the frame is supported, moving the flip-flop element, i.e. rotating it, to its desired orientation, and then permitting the flip-flop element to return or snap to its supported position at the frame under spring tension.

Various spring arrays for holding the flip-flop elements to their frames can be envisioned. The frames may be appropriately shaped or channeled internally to support and guide the springs, thereby also controlling the positions of the flip-flop elements at their frames. A spring may join two flip-flop elements of one of the squares, and particularly the adjacent elements, or a spring for a flip-flop element may be secured to its frame.

In one preferred embodiment of the invention, all of the flip-flop elements of the two square, rectangular array are of generally the same length, and each extends to but does not cross the length dimension of an adjacent, transversely oriented flip-flop element. In an improved embodiment, however, the flip-flop elements are of different respective lengths. The two vertical elements on the right vertical side of the character, as the character is observed by a viewer, approximately meet at the middle of that side and together extend the full height of the character. The horizontal elements at the top, bottom and center of the character extend leftward from the right side elements and extend across the length dimension of the left side vertical elements. The two remaining vertical elements at the left side of the character are of a height to extend between the two adjacent horizontal elements that cross the length dimension of these left side vertical elements. The support frame for the flip-flop elements is appropriately configured for supporting the differently sized flip-flop elements just described.

Other objects and features of the invention will become apparent from the following description and accompanying drawings.

BRIEF DESCRIPTION OF THE DRAWINGS

FIG. 2 is an elevational view showing one embodiment of an individual changeable character according to the invention;

FIG. 3 is a view in section taken along section line 3—3 in FIG. 2;

FIG. 4 is a partially exploded view showing in more detail the structure of one frame of the changeable character of FIG. 2;

FIGS. 7 and 8 are perspective views of an element of a character showing two different methods of securement of the element to its securement spring; and FIG. 9 is an elevational view showing another embodiment of an individual character according to the invention.

DESCRIPTION OF THE PREFERRED EMBODIMENT

Figures 1, 5, 6:
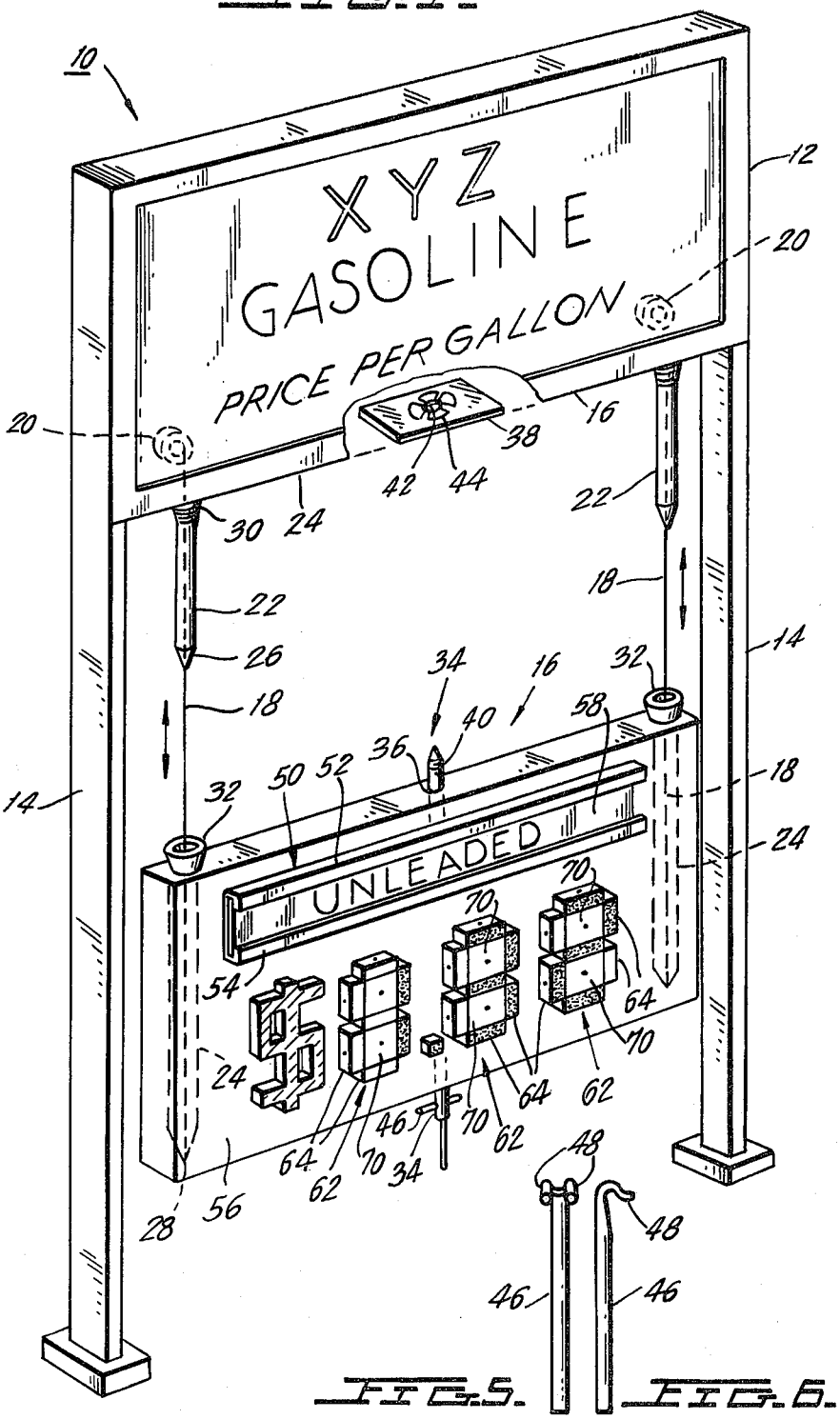
FIG. 1 is a perspective view of a display according to the invention.
FIGS. 5 and 6 are front and side views of a tool used in conjunction with the display of FIG. 1.

Referring now to the drawings, wherein like numerals indicate like elements, there is shown in FIG. 1 a first embodiment of a display constructed in accordance with the principles of the present invention and designated generally as 10. Display 10 includes a conventional permanent display sign 12 supported by a pair of vertically extending posts 14 and a movable, changeable display panel 16 depending therefrom. The permanent display sign 12 is adapted to display information which is not ordinarily changed; for example, sign 12 may display the trademark of the gasoline service station. Movable display panel 16 is intended to display information which is changed at relatively frequent intervals; for example, display 16 may display information concerning the price of gas being sold.

The movable panel 16 is connected to the stationary sign 12 by a pair of cables 18 which are connected at their upper ends to a respective conventional, roll-up type, spring retractor 20 which is encased within the sign 12. When the cable 18 is drawn off the retractor 20, the spring tension of the retractor increases and tends to drawn the cable back into the retractor. The retractor 20 preferably includes a self-locking mechanism which permits panel 16 to be maintained in its lower position much like a standard household shade. As a result, the panel 16 may be moved between an upper position adjacent the stationary sign 12 (wherein the display may be viewed at a relatively great distance) and the lower position illustrated in FIG. 1 (wherein the information on movable panel 16 may be changed).

When panel 16 is moved into its upper position, it is important that the panel be located at a predetermined orientation with respect to sign 12 and that it be held stationary in order that it does not move in response to wind and other weather conditions. To this end, a support structure is provided for locating panel 16 at the desired location. The support structure includes a pair of rigid posts 22 descending from the bottom end 24 of sign 12 and adapted to be received in a respective receiving shaft 24 formed in either end of the panel 16. A tapered, pointed tip 26 is defined at the bottom of each post 22 and nests in a cooperatively tapered shaped bottom end 28 of receiving shaft 24. A tapered collar 30 (which may be formed of nylon) is formed at the upper end of each post 22 and is adapted to be nested in correspondingly shaped openings formed in cooperating rubber cushions 32 located at the top of panel 16.

A respective cable 18 passes through each post 22 and is secured to the bottom of its corresponding receiving shaft 24. As a result, when panel 16 is raised toward the underside of stationary sign 12, the posts 22 are received within the shafts 24 with the tapered portions 26, 30 of posts 22 being received in the corresponding tapered portions 28, 32 of panel 16. As a result, the panel 16 is rigidly positioned against shifting in the wind or due to vibration, etc.

As described above, the rubber cushions 32 cooperate with the tapered collars 30 to precisely locate the panel 16 in the desired orientation. The cushions 32 further serve to absorb the impact of the panel 16 against the sign 12 when the panel 16 is raised into its upper position. If desired, additional cushioning strips can be located along the bottom 24 of sign 12.

Under normal conditions, the tension in spring retractors 20 will maintain the panel 16 in its upper position. Under certain adverse conditions, however, this force may not be sufficient. For example, if ice forms on the panel 16, the weight of the panel may become sufficiently great to overcome the spring force of the retractors 20. To overcome this problem, the invention preferably includes a fastening means which locks panel 16 in its upper position.

In the preferred embodiment, the fastening means comprises a shaft 34 which is rotatably received in an opening 36 extending vertically through the panel 16 and a mating flanged thrust nut 38. The shaft 34 is held against vertical shifting, for example by a keyway arrangement. The upper end of shaft 34 is screw threaded at 40.

The flanged thrust nut 38 is attached to the underside 24 of stationary sign 12 and includes an aperture 42 which is surrounded by a plurality of flaps 44. As the panel 16 is raised into its upper position under the spring force of retractors 20, the projecting threaded upper end of shaft 34 is pushed through the opening 42 and lifts the flaps 44 surrounding the opening. The uplifting of the flaps and their engagement in the threads 40 locks shaft 34 in place and thereby prevents panel 16 from being moved into its lower position due to the formation of ice on the panel.

When it is desired to lower panel 16, the shaft 34 is rotated to unscrew the threads 40 from the flaps 44. To this end, a handle 46 is provided the lower end of the shaft 34. A separate tool 48 (see FIGS. 5 and 6) may be used to engage the handle 46 when the panel 16 is in its upper position. The tool 48 includes a pair of fingers 48 which are adapted to engage the handle 46 so as to permit the user of the sign to rotate the handle 46 to unscrew the threads from the flaps 44. Once the threads 40 have been freed from the flaps 44, the panel 16 may be pulled down into its lower position and the information displayed on panel 16 may be changed.

As shown in FIG. 1, the display panel 16 has on the surface thereof means 50 for supporting changeable information. In particular, in a gasoline service station, the means 50 could support information about the type or quality of gasoline being sold. The means 50 comprises opposed upper and lower L-shaped panels 52, 54 which project out from the front face 56 of the display panel 16 and extend toward each other for defining, behind each of the panels 52, 54, a narrow slot for receiving the information strip 58 which is slid into the cooperating slots from the ends of the panels 52, 54. In order to maintain the information strip 58 between the panels 52, 54, it is preferable to locate a stop (not shown) at one end of the slot defined by the panels and to provide a spring clip (not shown) on the other side thereof. The spring clip and stop cooperate to lock the strip 58 in place.

Figure 10:
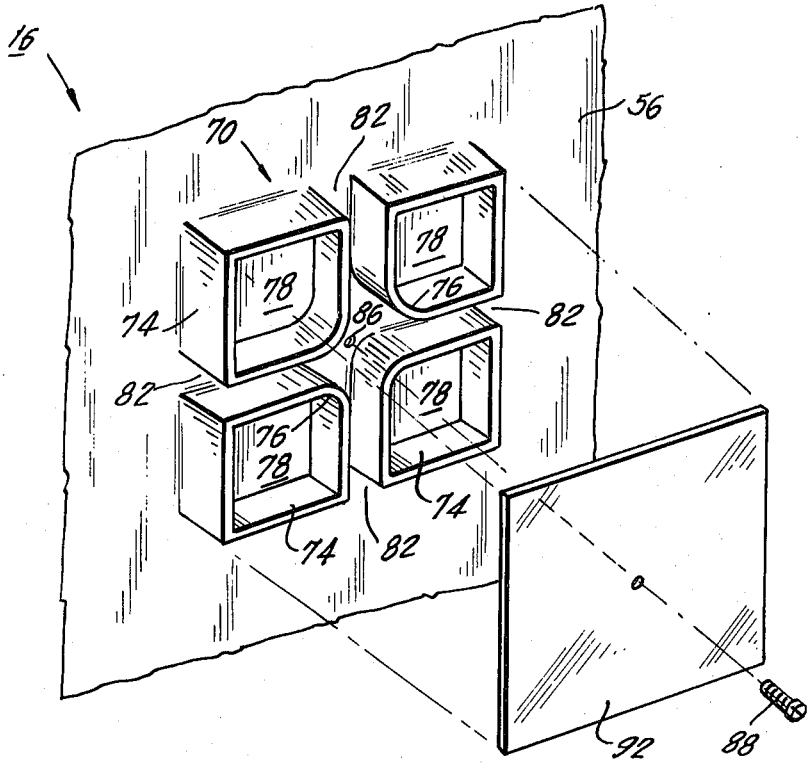
FIG. 10 is a partial prospective view showing an alternative structure of one frame of the changeable character of FIG. 2.

The panel 16 shown in FIG. 1 has only a single side for carrying information. Alternatively, a two-sided panel (not shown) may be provided, with both sides carrying information. The two sides may carry different respective information or may carry the same information, as desired. The panel 16 may be formed of any material. In the preferred embodiment, the panel 16 is formed in two separate halves (front and back) using a blow molding process. In such a case, the support panels 52, 54 and the character element support frames 70 (described below) may be integrally formed with the face 56 (see FIG. 10) of the panel 16. Alternatively, the frames 70 and panels 52, 54 may be separately attached to the panel, as described with reference to FIGS. 2–4.

In the preferred embodiment, display panel 16 includes a plurality of changeable characters 62 which enable the user of display 10 to quickly and easily change the information provided thereon. FIG. 2 illustrates one embodiment of an individual changeable character 62 constructed in accordance with the present invention. The individual character 62 is defined by a total of seven flip-flop elements 64 in the form of rectangular bars which are supported in the rectangular array shown in FIG. 2, wherein there are two quadrilaterals or square arrays of four bars each, one square array atop the other, and the bar between the two square arrays is a common bar. With the seven flip-flop elements 64 in the illustrated rectangular array, every numeral from 0–9 can be produced. Each rectangular bar may be a rectangular molded plastic bar. Corresponding bars of each quadrilateral are of the same size and all bars may be of the same size and particularly of equal length. The bars are of such length and are held in position such that, as shown in FIG. 2, the lengthwise ends of the bars terminate generally where they begin to intersect the lengthwise dimensions of the adjacent bars.

One flat, long surface 66 of each flip-flop element 64 is preferably light or white in color and the opposite surface 68 is a contrasting color, e.g. dark or black. By selective rotation of the bars to expose one of the surfaces 66 and 68, any numeral can be reproduced for the character 62. Each flip-flop element 64 rotates about a respective axis 60 through its longitudinal center. The flip-flop elements may alternatively be arranged and supported to enable them to be flipped to expose different ones of the surfaces, not necessarily the opposite ones.

The support for the character 62 comprises two molded plastic, square shaped support frames 70, which are shown more clearly in FIGS. 3 and 4. Each frame 70 includes a front or outer panel 72 which closes the front side of the frame. When the frame 70 is installed at the front surface 56 of the display panel 16, the panel 72 is above and spaced from the front surface 56 of the panel 16 (see FIG. 3). Uptanding side walls 74 extend from the panel 72 and define the square shape of the frame 70. The exteriors of the side wall 74 define the surfaces against which the flip-flop elements 64 abut. The side walls 74 preferably taper slightly inwardly from the panel 72. When the frame 70 is applied to the surface 56 of the panel 16, the upper edges 75 of the frame side walls rest against the surface 56. The taper of the side walls 74 creates a very slight pocket between the side walls 74 and the panel surface 56 and this pocket helps assure that the flip-flop elements 64 will be held in place against the side walls 74, without slipping forward of the support. The interior space between the walls 74 includes the curved spring guide channel walls 76 which are of the same height as the side walls 74. The walls 76 also define respective pockets 78 which can be fitted over thermoformed blisters or slightly upraised locating sections 80 that are formed on the surface 56 of the panel 16. In this manner, the two separate frames 70 of the support frame 62 can be correctly positioned (see FIG. 2). The walls 76 define channels 82 for guiding the springs 84, described below, that extend between the flip-flop elements 64. The panel 72 has a hole 86 defined in it for receiving a bolt 88 therethrough. This bolt in turn extends to a nut 90 located inside the panel 16. The bolt and nut combination hold the frame 70 to the panel 16.

In the foregoing embodiment, the frames 70 are formed separately from the display panel 16 and are attached thereto by bolts 88. If desired, the frame 70 may be integrally formed with the face 56 of panel 16 in the manner illustrated in FIG. 10. As shown therein, the four pockets 78 are defined by respective side walls 74 and channel walls 76 which are integrally molded with the face 56 of panel 16. The spring elements 84 may be located in the resulting channels 82 in a similar manner to that illustrated in FIG. 4. In order to hold the spring elements 84 in channels 82, an additional cover plate 92 (shown in phantom) is placed over the walls 74, 76. Cover plate 92 is coupled to panel 16 using a bolt and nut arrangement (not shown) which extend through opening 62. In the preferred embodiment, the outer ends of cover plate 92 extend beyond the walls 74 of the support frame 70 such that the flip-flop elements 64 rest against the edges of plate 92 and do not directly contact walls 74.

The manner in which the flip-flop elements 64 are coupled to support frames 70 will now be described. As shown in FIG. 4, a pair of tension springs 84 is provided for each frame 70. Each spring 84 extends from the longitudinal center of one flip-flop element 64 to the longitudinal center of an adjacent flip-flop element 64. The springs pass through the channels 82 which guide and position the springs. Each spring 84 draws the flip-flop elements 62 at its opposite ends toward the frame 70. Referring to FIG. 2, it can be seen that the center flip-flop element 64 need be connected only to either the top or bottom frame 70. In the embodiment illustrated, the center flip-flop element is connected only to the top frame 70. Consequently, the distal end of the spring 84 which is associated with the lower frame 70 is connected directly to the panel 16 rather than to another flip-flop element 64.

Stops (not shown) may hold each bar in its correct position. However, the respective spring 84 passing through the channel 82, coupled with the slight tapering of the side walls 74 of the support frame 70, cooperate to position and hold each flip-flop element 64 in its correct position.

Due to the design of the frame 70, only two springs 84 are necessary for holding four flip-flop elements in place. In an alternate arrangement, a respective tension spring could be provided for each of the four flip-flop elements 64 on a frame 70, instead of using one spring to hold two flip-flop elements together. Each spring would then be affixed elsewhere in the frame. In place of springs, rubber-band type connectors or other connectors may be provided.

One technique for connecting a spring 84 to a respective flip-flop element 64 is shown in FIG. 7. As shown therein, a knurled surface rod 94 is integrally molded into the flip-flop element 64 at the longitudinal center of the element. The outer end of the rod 94 is formed in the shape of a ball 96 (see FIG. 8) which defines a bearing. The diameter of the coils at the end of the tension spring 84 is reduced so that the spring will wrap around and securely grasp the ball bearing 96, securing the spring to the rod and thus to the associated flip-flop element 64. Significantly, this arrangement permits the flip-flop elements 64 to be rotated without rotating the corresponding spring element 84.

An alternate connection between the tension spring 84 and the flip-flop element 64 is shown in FIG. 8. Here the ball 96 is integrated at the end of a smooth-surfaced rod 98 which is of a diameter to snugly fit into and pass through the hole 100 across the central portion of the flip-flop element 64. A pin 102 at the end of the rod 98 projects beyond the surface of the flip-flop element 64 and is fixedly engaged by the push nut fastener 104, whose resilient flaps securely engage the pin 102.

In order to change the orientation of a flip-flop element 64 to show either of its surfaces 66 and 68, an operator manually grasps the flip-flop element, lifts it away from the display panel 16 by stretching the respective spring sufficiently, rotates the flip-flop around its longitudinal center axis 60 so that the desired surface 66 or 68 is exposed and permits the spring to then draw the flip-flop element 64 back to its correct position at the side wall 74 to be securely held there by the spring tension. By simply rotating the seven flip-flops to appropriate respective positions, an operator can change the displayed numeral charactor to any other numeral character.

A second embodiment of a 62' character is shown in FIG. 9. All of the features of the first above-described embodiment appear in this second embodiment. However, the individual flip-flop elements 64' of the character are not uniformly sized, for reasons discussed below. As a result, the configuration of the elements 64' and the design of their support frame 70' is slightly modified from the first embodiment just described. The primed elements of the second embodiment of a character are somewhat modified but correspond to elements of the first embodiment of a character 62 having the same number.

The individual flip-flop elements 64' are supported around their respective frames 70'*a* and 70'*b*. The directions right and left, mentioned below, are directions as the viewer is looking at the diaplay. Right side flip-flop elements 64'*a* and 64'*b* are relatively tall elements and together extend the full height of the character. They cross the length dimensions of the below-described horizontal elements and they meet approximately at the horizontal center line of the character. The top 64'*c*, middle 64'*d* and bottom 64'*e* horizontal flip-flop elements extend leftward from the vicinity of the vertical elements 64'*a*, 64'*b*, which they nearly intersect, to the left side of the character. The two left-side vertical elements 64'*f* and 64'*g* are shorter in length than the right-side vertical elements, and the left-side elements fit between and have their length dimensions intersected by the adjacent horizontal flip-flop elements. In particular, vertical element 64'*f* extends between horizontal elements 64'*c* and 64'*d*, while vertical element 64'*g* extends between horizontal elements 64'*d* and 64'*e*.

In the first embodiment illustrated in FIG. 2, there are gaps in many of the numerals formed by the changeable character. For example, the numeral "3" will have gaps in the upper, lower and middle right hand corners of the figure. In contrast, no gap appears in the numeral "3" of the embodiment illustrated in FIG. 9. As a result of forming the flip-flop elements as shown in FIG. 9, the characters which may be produced using these flip-flop elements 64' most closely will approximate the actual appearance of numerals. With the flip-flop elements of FIG. 9, there is only a small problem with the numeral "0", in that a small part of the "0" at the left side at the center (at the element 64'*d*) is missing. It has been found, however, that viewers tend to view the circle as completed and ignore the break.

As with the first embodiment, it is advisable for the springs 84' to meet their respective flip-flop elements 64' at the longitudinal centers of the elements. Therefore, the frames 70'*a* and 70'*b* must be appropriately configured with somewhat oddly shaped channels 82' to assure that the springs 84' meet the flip-flop elements 64' at the desired locations. A precise word description of the shapes of the channels 82' for the frames 70'*a* and 70'*b* is not necessary, as the shapes and orientations of these channels shown in FIG. 9 is self-explanatory, when it is considered that the channels direct the respective springs 84' to the centers of the respective flip-flop elements 64'. The channel arrangements of the frames 70'*a* and 70'*b* cannot be uniform or symmetric, as with the frames 70 of the first embodiment.

Although the present invention has been described in connection with a plurality of preferred embodiments, thereof, many variations and modifications will now become apparent to those skilled in the art. It is preferred, therefore, that the present invention be limited not by the specific disclosure herein, but only by the appended claims.

What is claimed is:

1. A changeable display, comprising:

a plurality of mechanical flip-flop elements, each said flip-flop element having a first side which is entirely of a first color, and a second side which is entirely of a second color;

a plurality of frame means, each said frame means for supporting and positioning a respective group of said flip-flop elements in an array, each array corresponding to a discrete character whereby said display is adapted to display several characters; and resilient means which connect each said flip-flop element to its respective said frame means to enable each flip-flop element to be manually individually retracted away from its respective frame means and then rotated to have a desired one of its first and second sides face outwardly of the display.

2. The display of claim 1, wherein each said frame means includes channel means formed therein; said resilient means being received in said channel means and being connected to said flip-flop elements to bias them toward their respective said frame means.

3. The display of claim 1, wherein each of the groups of flip-flop elements representing a character comprises seven flip-flop elements arranged in two quadrilaterals, wherein one of said flip-flop elements is common to both of said quadrilaterals.

4. The display of claim 3, wherein each frame means for a discrete character comprises two adjacent quadrilateral frames and each of the frames being disposed in the middle of a respective quadrilateral.

5. The display of claim 4, further comprising a support panel for supporting said frame means thereon.

6. The display of claim 5, wherein said frame means is separate from and attached to said support panel.

7. The display of claim 6, wherein said support panel includes positioning elements thereon for orienting and positioning said frame means on said support panel when said frame means are secured to said support panel.

8. The display of claim 7, wherein said positioning elements comprise said support panel being provided with blisters and said frame means includes pockets that cooperate with said blisters to position said frame means on said support panel.

9. The display of claim 4, wherein each of the quadrilaterals has a horizontal and a vertical dimension and has opposite horizontal sides and opposite vertical sides; and wherein horizontally oriented said flip-flop elements are arrayed along the horizontal sides of the quadrilaterals and vertically oriented said flip-flop elements are arrayed along the vertical sides of the quadrilaterals, and said two quadrilaterals share a single horizontal said flip-flop element between them.

10. The display of claim 9, wherein the length of said horizontal flip-flop elements along the horizontal dimension are all equal to each other and equal to the horizontal dimension of said frames and the length of said vertical flip-flop elements along the vertical dimension are equal to each other and equal to the vertical dimension of said frames.

11. The display of claim 10, wherein all said flip-flop elements in each said quadrilateral of one character are of the same length.

12. The display of claim 9, wherein the two said quadrilaterals of a character are of equal size and the correspondingly positioned flip-flop elements of both said quadrilaterals are of equal length dimensions between their lengthwise ends.

13. The display of claim 9, wherein:

for the two said quadrilaterals of a character, there is a total of three said horizontal flip-flop elements and said horizontal flip-flop elements have their length dimensions extending left and right, and each said horizontal flip-flop element has a left and a right end;

the two said vertical flip-flop elements respectively at the right sides, as the display is viewed, of the two quadrilaterals together are of a height to extend past said right ends of all three said horizontal flip-flop elements and to extend the entire vertical dimension of said character;

each of said two vertical flip-flop elements respectively at the left sides of said two quadrilaterals is of a shorter height than said vertical flip-flop elements at the right sides of said two quadrilaterals, and said vertical flip-flop elements at the left sides of said quadrilaterals have vertical top and bottom lengthwise ends; said horizontal flip-flop elements are of a length such that their said left ends extend far enough to the left so that said horizontal flip-flop elements extend past said vertical ends of said left vertical flip-flop elements.

14. The display of claim 13, wherein said two quadrilaterals of a character are of equal size and the correspondingly positioned said flip-flop elements of both said quadrilaterals are of equal length dimensions between their lengthwise ends.

15. The display of claim 4, wherein said resilient means comprise a plurality of tension springs.

16. The display of claim 15, wherein each of said springs in one of said quadrilaterals of each said character extends between a different pair of said flip-flop elements in that said quadrilateral.

17. The display of claim 16, wherein said two flip-flop elements joined by a said spring are two adjacent said flip-flop elements around said quadrilateral.

18. The display of claim 17, wherein said first and second sides of said flip-flop elements are opposite sides of said flip-flop elements.

19. The display of claim 18, wherein said springs are attached to their said flip-flop elements generally at the center along the lengthwise dimensions of said flip-flop elements.

20. The display of any of claims 16, 17 or 19, wherein for the other said quadrilateral of each said character, there is a said tension spring for securing one of the respective said flip-flop elements to the respective support frame, and the remaining two respective said flip-flop elements at said other quadrilateral have a tension spring extending between them for holding them to and positioning them at said frame of the other said quadrilateral.

21. The display of any of claims 16, 18 or 19, wherein each said element includes means for engaging its respective said spring for enabling rotation of each said flip-flop element independently of said spring.

22. The display of claim 21, wherein said means for engaging said spring comprises a ball-type connection between said spring and said flip-flop element.

23. The display of claim 22, wherein said ball-type connection comprises a ball supported on a side of said flip-flop element that is transverse to said first and second sides thereof and said spring being shaped for engaging and holding onto said ball.

24. The display of either of claims 16 or 17, further including channel means formed in said frames and wherein each of said springs which joins two of said flip-flop elements also passes through said channel means; said channel means are shaped and positioned for holding the respective said flip-flop elements connected to each said spring at a position for maintaining the quadrilateral arrangement of the frame means and the respective flip-flop elements.

25. The display of claim 2, wherein said first and second sides of said flip-flop elements are opposite sides of said flip-flop elements.

26. The display of claim 25, wherein said resilient means are springs which are attached to said flip-flop elements generally at the center along the lengthwise dimensions of said flip-flop elements.

27. The display of claim 1, further comprising a support panel for supporting said frame means thereon.

28. The display of claim 27, wherein said support panel further includes other means for supporting other indicators besides said flip-flop elements.

29. The display of claim 28, wherein said other means includes elements defining a slide-in channel for receiving an indicator which may be removably installed in said slide-in channel.

30. The display of claim 29, further comprising a slide-in indicator removably slid into said slide-in channel.

31. The display of any one of claims 1, 2, 3 or 4, wherein said changeable display includes a face on which said flip-flop elements are located and wherein said frame means are integrally formed in said face.

32. A changeable display, comprising:

a plurality of mechanical flip-flop elements, each said flip-flop element having first and second sides which respectively have first and second visually distinct characteristics;

frame means for supporting and positioning said flip-flop elements in an array comprising seven flip-flop elements arranged to two quadrilaterals, one of said flip-flop elements being common to both said quadrilaterals, said frame means comprising two adjacent quadrilateral frames and each frame being disposed in the middle of a respective said quadrilateral; and resilient means which connect said flip-flop elements to said frame means to enable said flip-flop elements to be manually individually retracted away from said frame means and then rotated to have a desired one of its respective first and second sides face outwardly of said display, said resilient means comprising a plurality of tensions springs, each said spring in one of said quadrilaterals extending between a respective pair of flip-flop elements in that said quadrilateral.

33. The display of claim 32, wherein said two flip-flop elements joined by a said spring are two adjacent said flip-flop elements around said quadrilateral.

34. The display of claim 33, wherein said first and second sides of said flip-flop elements are opposite sides of said flip-flop elements.

35. The display of claim 34, wherein said springs are attached to their said flip-flop elements generally at the center along the lengthwise dimensions of said flip-flop elements.

36. The display of any of claims 32, 33 or 35, wherein for the other said quadrilateral, there is a said tension spring for securing one of the respective said flip-flop elements to the respective support frame, and the remaining two respective said flip-flop elements at said other quadrilateral have a tension spring extending between them for holding them to and positioning them at said frame of the other said quadrilateral.

37. The display of any of claims 32, 34 or 35, wherein each said element includes means for engaging its respective said spring for enabling rotation of each said flip-flop element independently of said spring.

38. The display of claim 37, wherein said means for engaging said spring comprises a ball-type connection between said spring and said flip-flop element.

39. The display of claim 38, wherein said ball-type connection comprises a ball supported on a side of said flip-flop element that is transverse to said first and second sides thereof and said spring being shaped for engaging and holding onto said ball.

40. The display of either of claims 32 or 33, wherein each of said springs which joins two of said flip-flop elements also passes through said channel means; said channel means are shaped and positioned for holding the respective said flip-flop element connected to each said spring at a position for maintaining the quadrilateral arrangement of the frame means and the respective flip-flop elements.

* * * * *